US012650252B2

(12) United States Patent
Park et al.

(10) Patent No.: US 12,650,252 B2
(45) Date of Patent: Jun. 9, 2026

(54) REFRIGERATOR

(71) Applicant: LG ELECTRONICS INC., Seoul (KR)

(72) Inventors: Sanggoo Park, Seoul (KR); Jeongwon Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 303 days.

(21) Appl. No.: 18/023,887

(22) PCT Filed: Aug. 27, 2021

(86) PCT No.: PCT/KR2021/011537
§ 371 (c)(1),
(2) Date: Feb. 28, 2023

(87) PCT Pub. No.: WO2022/080654
PCT Pub. Date: Apr. 21, 2022

(65) Prior Publication Data

US 2023/0314050 A1 Oct. 5, 2023

(30) Foreign Application Priority Data

Oct. 12, 2020 (KR) ..... 10-2020-0131053

(51) Int. Cl.
*F25B 39/00* (2006.01)
*F25B 39/02* (2006.01)
*F25D 11/02* (2006.01)

(52) U.S. Cl.
CPC ..... *F25B 39/00* (2013.01); *F25B 39/02* (2013.01); *F25D 11/02* (2013.01); *F28F 2210/10* (2013.01)

(58) Field of Classification Search
CPC ..... F25B 39/00; F25B 39/02; F25D 11/02; F28F 2210/10
See application file for complete search history.

(56) References Cited

U.S. PATENT DOCUMENTS 5,172,759 A 12/1992 Shimoya et al.
2004/0118152 A1* 6/2004 Ha ..... F25B 39/02 165/172

(Continued)

FOREIGN PATENT DOCUMENTS

JP H 10-38487 A 2/1998
KR 10-2001-0000003 U 1/2001

(Continued)

OTHER PUBLICATIONS

KR-20110087917-A translation.*

(Continued)

*Primary Examiner* — Elizabeth J Martin
(74) *Attorney, Agent, or Firm* — KED & ASSOCIATES, LLP

(57) ABSTRACT

Provided is a refrigerator. The refrigerator includes a main body having a storage space and an evaporator accommodated in the main body and configured to cool cold air supplied to the storage space. The evaporator includes a pair of headers facing each other, a plurality of flat tubes which have both ends respectively connected to the pair of headers and through which a refrigerant flows, and a plurality of plate-shaped heat dissipation fins penetrated by the plurality of flat tubes. Each of the flat tubes has a plate shape and is coupled to each of the headers in a state of being inclined at a set angle.

17 Claims, 8 Drawing Sheets

(56) References Cited

U.S. PATENT DOCUMENTS

| | | | | |
|---|---|---|---|---|
| 2017/0363335 | A1 | 12/2017 | Arbogast et al. | |
| 2019/0049185 | A1* | 2/2019 | Ito | F28D 1/0246 |
| 2021/0018233 | A1* | 1/2021 | Higashiiue | F25B 39/02 |

FOREIGN PATENT DOCUMENTS

| | | | | |
|---|---|---|---|---|
| KR | 20110087917 | A | * | 1/2010 |
| KR | 10-2011-10087917 | A | | 8/2011 |
| KR | 10-2013-0070309 | A | | 6/2013 |

OTHER PUBLICATIONS

International Search Report (with English Translation) and Written Opinion dated Jan. 21, 2022 issued in Application No. PCT/KR2021/011537.

* cited by examiner

REFRIGERATOR

CROSS-REFERENCE TO RELATED PATENT APPLICATIONS

This application is a U.S. National Stage Application under 35 U.S.C. § 371 of PCT Application No. PCT/KR2021/011537, filed Aug. 27, 2021, which claims priority to Korean Patent Application No. 10-2020-0131053, filed Oct. 12, 2020, whose entire disclosures are hereby incorporated by reference.

TECHNICAL FIELD

The present disclosure relates to a refrigerator.

BACKGROUND ART

Refrigerators are electric appliances for storing food at a low temperature.

Refrigerators are classified into a top-mount type, a side-by-side type, and a bottom-freezer type according to the location of the refrigerating compartment and/or the freezing compartment. A refrigeration cycle for cooling cold air in the refrigerator is installed inside the refrigerator, a compressor and a condenser, which constitute the refrigeration cycle, are accommodated in a machine room, and an evaporator is mounted on a rear surface of a main body of the refrigerator.

In detail, to install the evaporator in the main body of the refrigerator, an evaporator having a thin thickness, a narrow width, and a long length is used. Also, the evaporator is mounted in the refrigerator in the form, in which a length of the evaporator extends in a vertical direction.

Korean Patent Publication No. 10-2013-0070309 discloses an evaporator, which is provided with a refrigerant tube and body provided with a refrigerant tube and a defrost heater provided with an evaporator body and first and second heater portions, which are spaced apart from each other in a vertical direction of the evaporator body, wherein the evaporator body and the first and second heater portions are disposed in the vertical direction, and a refrigerator including the same.

However, in the refrigerator according to the related art, an evaporator having a circular cross-section and provided as a refrigerant tube that is bent several times is used. However, in the case of a heat exchanger having such a circular cross-section, a cavity is defined in a rear surface of the tube based on a direction in which cold air flows, and thus, heat exchange with the cold air may not be smoothly performed.

In addition, since the evaporator having such a circular cross section requires a certain width by arranging the circular tubes in two rows, there is a disadvantage in that a storage space is reduced so as to secure a space for installing the evaporator.

DISCLOSURE

Technical Problem

Embodiments provide a refrigerator in which a flat tube heat exchanger is applied to improve heat exchange efficiency and reduce a space for accommodating an evaporator, thereby increasing in capacity of the refrigerator.

Technical Solution

In one embodiment, a refrigerator includes: a main body having a storage space; and an evaporator accommodated in the main body and configured to cool cold air supplied to the storage space, wherein the evaporator includes: a pair of headers facing each other; a plurality of flat tubes which have both ends respectively connected to the pair of headers and through which a refrigerant flows; and a plurality of plate-shaped heat dissipation fins penetrated by the plurality of flat tubes, wherein each of the flat tubes has a plate shape and is coupled to each of the headers in a state of being inclined at a set angle.

In the state in which the flat tube is connected to the header, an angle between a central line of a vertical cross-section of the flat tube and an extension direction of the header may be about 20 degrees to about 80 degrees.

An upper end of the flat tube may be inclined forward or backward from a lower end of the flat tube.

A wide surface of the flat tube may be connected to the header in a state of being inclined in a direction crossing a flow direction of the cold air.

The flow direction of the cold air may be a direction from a lower end to an upper end of the evaporator.

The flat tube may be provided in plurality, which are arranged along the extension direction of the header.

In the evaporator, a single header may be connected to each of one end and the other end of the flat tube.

A plurality of microchannels through which the refrigerant flows may be provided in each of the flat tube, wherein the plurality of microchannels may be arranged in a direction crossing the flow direction of the cold air passing through the evaporator.

The plurality of microchannels may be arranged within the flat tube in a direction inclined at an angle of about 90 degrees with respect to a central line of the header.

The header may include a tube insertion hole through which the flat tube passes, wherein the tube insertion hole may be defined along an outer circumferential surface of the header in a state of being inclined at a set angle with respect to a central line of the header.

An upper end and a lower end of the tube insertion hole may not be disposed in the same extension line in a vertical direction.

The heat dissipation fin may include a through-surface through which the flat tube passes, wherein the through-surface may be perpendicular to the ground.

The heat dissipation fin may have a tube hole through which the flat tube passes, wherein the tube hole may have a shape corresponding to a cross-section of the flat tube.

The plurality of heat dissipation fins may be arranged at set intervals between the two flat tubes adjacent to each other in a vertical direction.

A refrigerant inlet through which the refrigerant is introduced may be provided at an upper end of any one of the pair of headers, and a refrigerant outlet may be provided at a lower end.

The details of one or more embodiments are set forth in the accompanying drawings and the description below. Other features will be apparent from the description and drawings, and from the claims.

Advantageous Effects

The refrigerator including the foregoing constitutions according to the embodiment of the present invention has following effects.

In the refrigerator according to the embodiment, the evaporator installed on the rear wall inside the refrigerator may include the pair of headers, the flat tube provided between the pair of headers, and the heat dissipation fin having the plate shape. Therefore, the single header may be provided at each of both the sides of the flat tube to minimize the space in which the evaporator is installed, thereby securing the wider storage space in the refrigerator.

In addition, the flat tube may not be coupled in the state in which the wide surface is completely perpendicular to the central axis of the header, but be coupled to be inclined at the set angle. Thus, the interference with the flow of the cold air flowing from the lower end to the upper end of the evaporator may be minimized to improve the heat exchange efficiency.

In addition, the header may include the tube insertion hole that is penetrated in the inclined structure along the outer circumferential surface of the header so that the flat tube is inserted to be coupled. Therefore, in the state in which the flat tube is coupled to the header, the wide surface of the flat tube may be inclined at the set angle.

In the heat dissipation fins, the through-surfaces through which the flat tube passes may be arranged at the regular intervals along the extension direction of the flat tube. In addition, the heat dissipation fins may be arranged at the set intervals between the flat tubes adjacent to each other in the vertical direction. In this structure, the contact area with the cold air may be maximized, and the condensed water condensed on the surface of the heat dissipation fin may be easily discharged.

In addition, the extension direction of the header of the flat tube heat exchanger and the flow direction of the cold air may be similar to each other to reduce the accommodation area of the heat exchanger and also improve the heat exchange efficiency.

*34FIG. 4 is a front view of the evaporator according to an embodiment.

Figure 3:
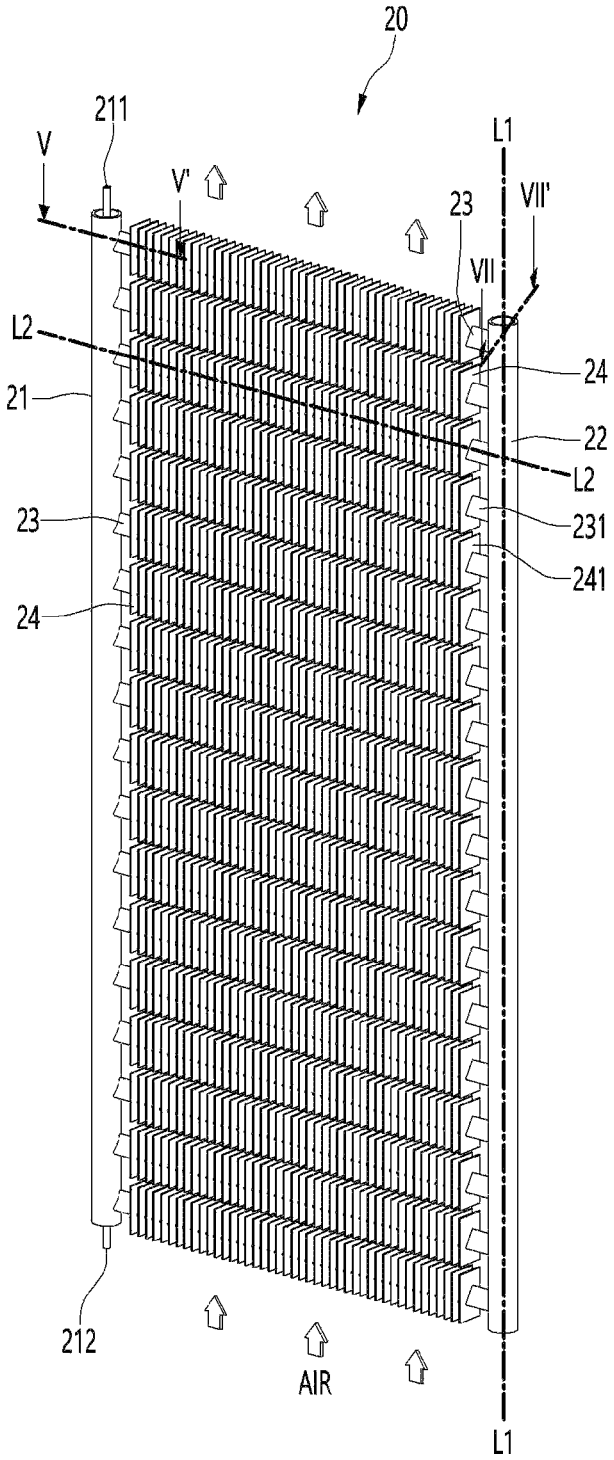
FIG. 3 is a perspective view illustrating the evaporator of the refrigerator according to an embodiment.
Figure 5:
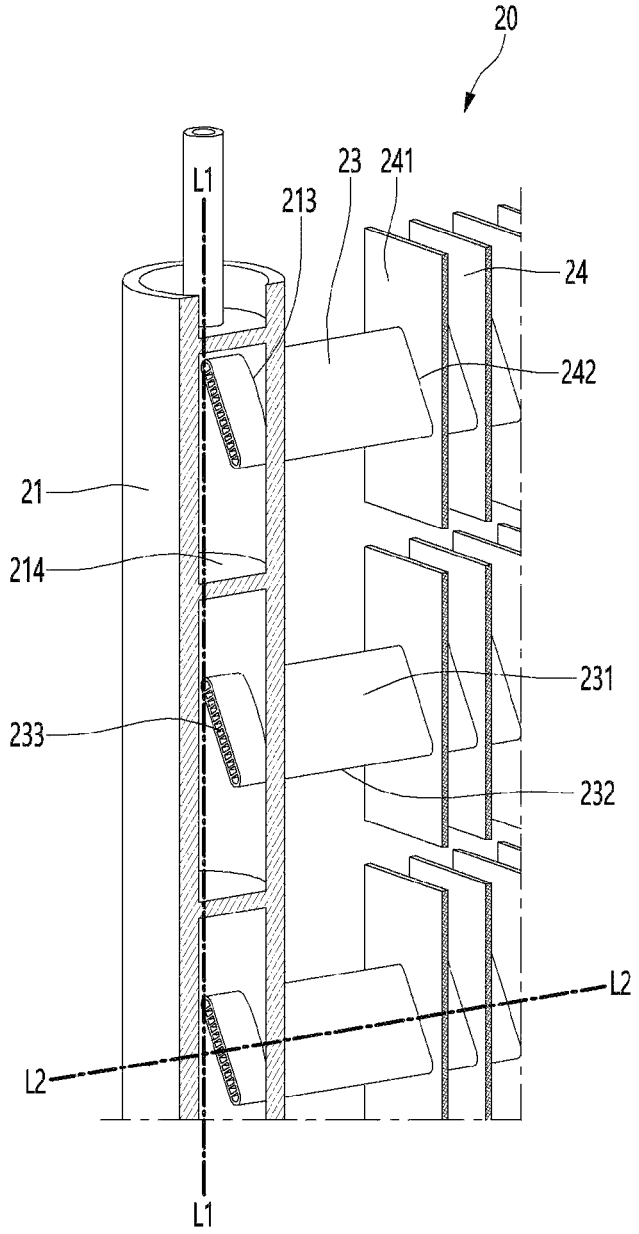

FIG. 5 is a cross-sectional view taken along line V-V' of FIG. 3.

Figure 6:
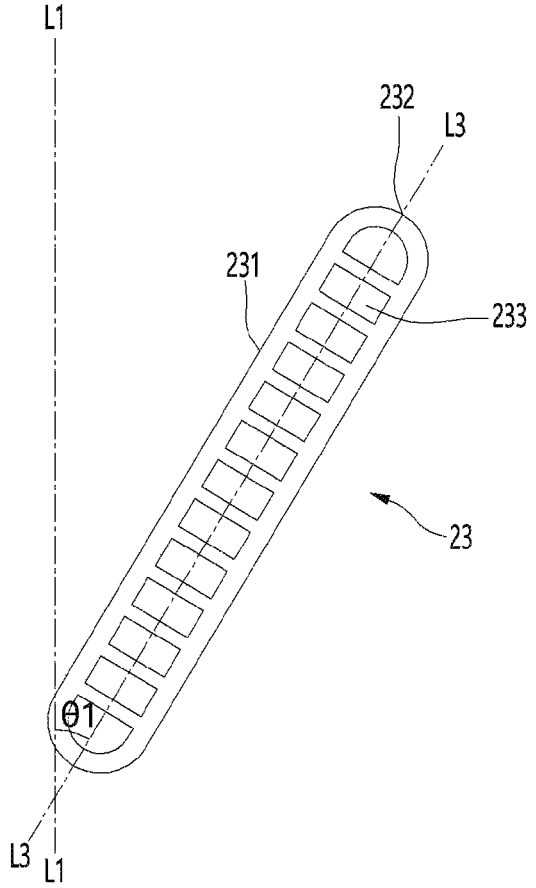

FIG. 6 is a cross-sectional view of a flat tube according to an embodiment.

Figure 7:
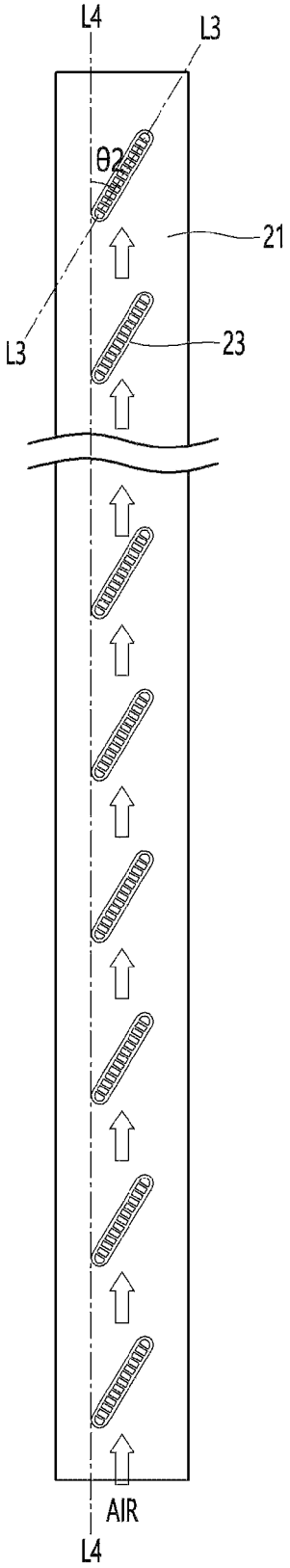

FIG. 7 is a cross-sectional view taken along line VII-VII' of FIG. 3.

Figure 8:
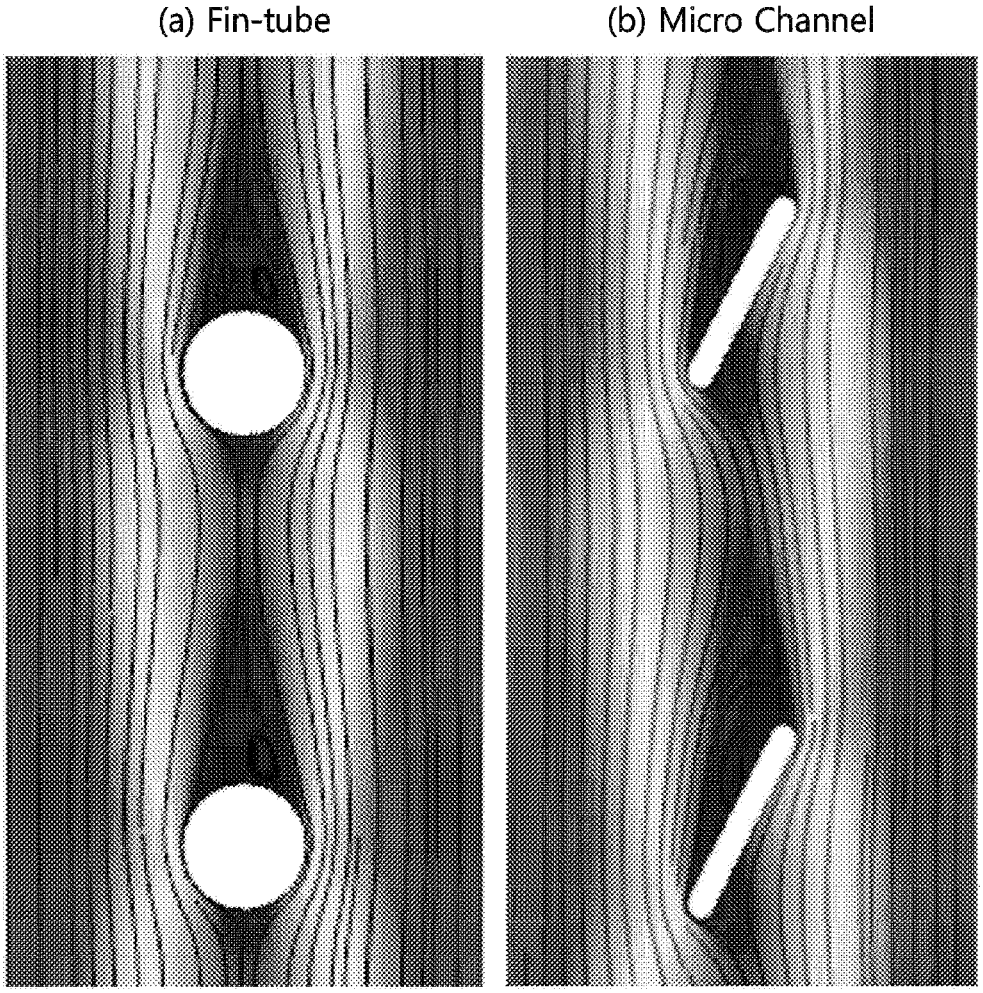

FIG. 8 is a view illustrating a flow of cold air within the evaporator.

MODE FOR INVENTION

Hereinafter, a refrigerator and an evaporator according to an embodiment will be described in with reference to the accompanying drawings.

Figure 1:
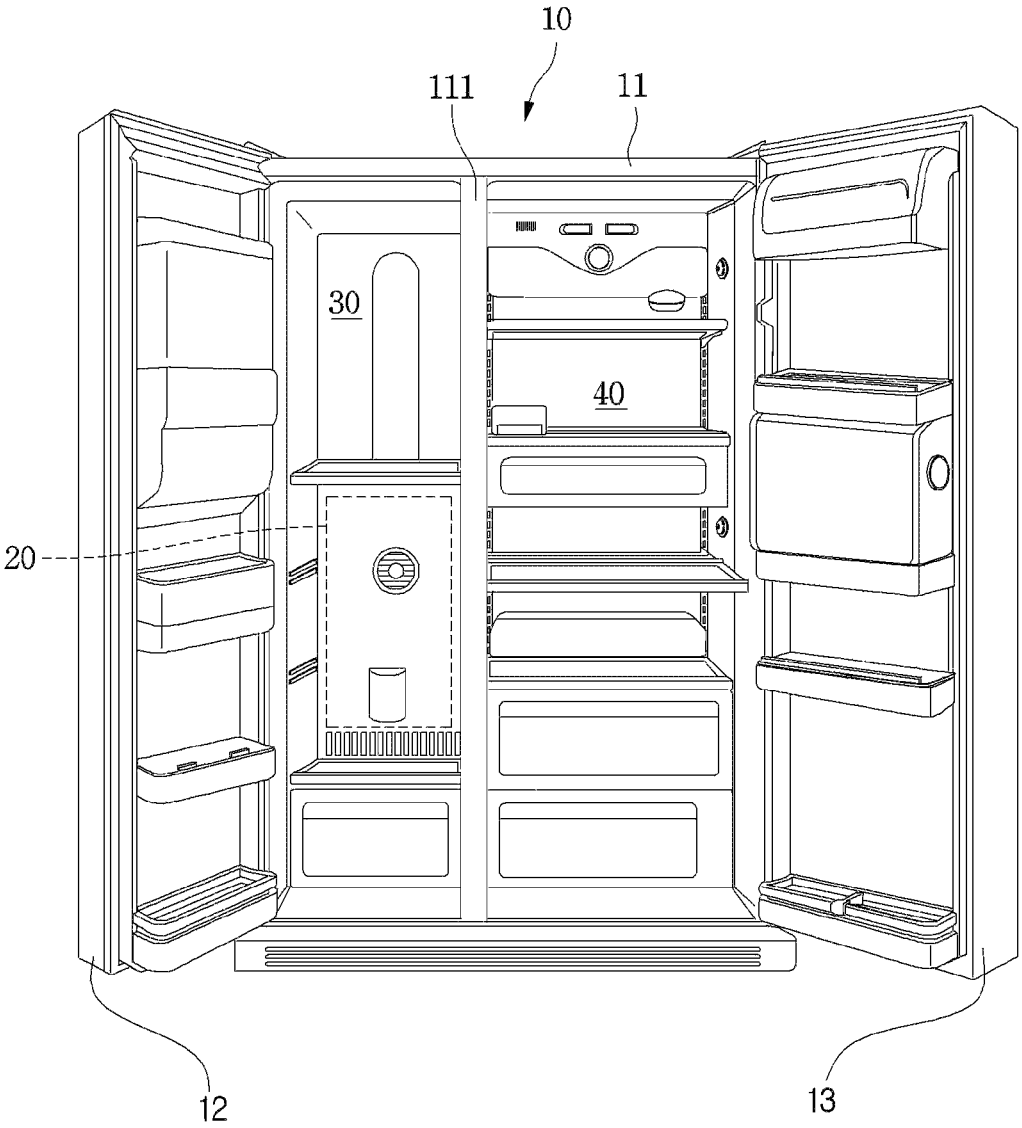
FIG. 1 is a perspective view illustrating an inner structure of a refrigerator according to an embodiment.
Figure 2:
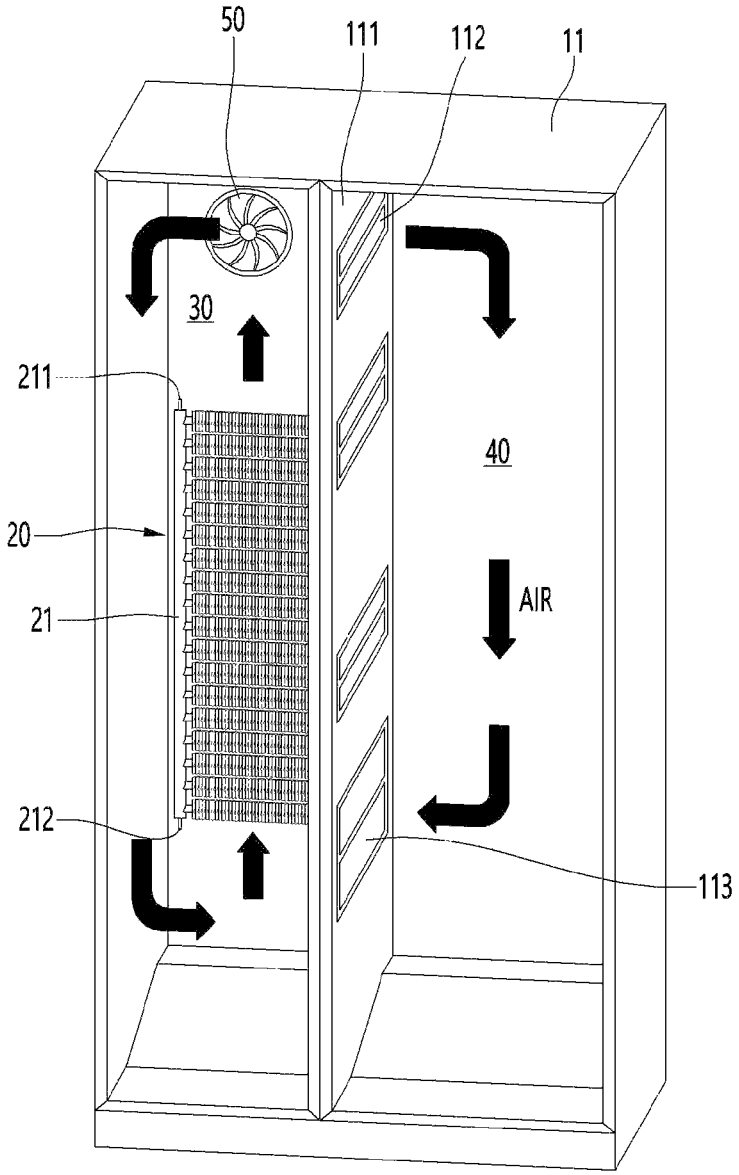
FIG. 2 is a view illustrating a state in which an evaporator is attached to a rear wall of the refrigerator according to an embodiment.

FIG. 1 is a perspective view illustrating an inner structure of a refrigerator according to an embodiment. Also, FIG. 2 is a view illustrating a state in which an evaporator is attached to a rear wall of the refrigerator according to an embodiment.

Referring to the drawings, a refrigerator 10 according to an embodiment is a side-by-side type refrigerator in which a freezing compartment and a refrigerating compartment are disposed at left and right sides, respectively.

In detail, the refrigerator 10 according to an embodiment includes a main body 11 in which a freezing compartment 30 and a refrigerating compartment 40 are provided, a refrigerating compartment door 13 and a freezing compartment door 12, which open or close the freezing compartment 40 and the freezing compartment 40, respectively, and an evaporator 20 installed in the main body 11.

The freezing compartment 30 and the refrigerating compartment 40 are partitioned by a barrier, and the evaporator 20 is accommodated inside a wall surface of the main body 11 constituting the freezing compartment 30.

The evaporator 20 has a rectangular shape having a length longer than a width thereof and is accommodated in an erect state inside the main body 11.

A cold air fan 50, which suctions the cold air provided from the evaporator 20 to supply the cold air to the freezing compartment 30 and the refrigerating compartment 40, is installed above the evaporator 20.

Also, a discharge duct 112 that discharges the cold air supplied by the cold air fan 50 into the refrigerating compartment 40 may be provided in an upper end of the barrier 111, and a return duct 113 that supplies the cold air circulated inside the refrigerating compartment 40 again toward the evaporator 20 may be provided in a lower end of the barrier 111.

When cold air is generated through heat exchange with the refrigerant in the evaporator 20, the cold air fan 50 operates, and thus, the cold air is supplied to each of the freezing compartment 30 and the refrigerating compartment 40 by the cold air fan 50. Thereafter, the cold air circulated through each of the freezing compartment 30 and the refrigerating compartment 40 is supplied again to the space, in which the evaporator 20 is disposed, along a flow path provided in a lower end of the refrigerator.

Here, the cold air supplied to the refrigerating compartment 40 is discharged through the discharge duct 112 provided in the upper end of the barrier 111 to return toward the evaporator 20 through the return duct 113 provided in the lower end of the barrier 111, and then, the cold air is circulated through the freezing compartment 30 and the refrigerating compartment 40.

Figure 4:
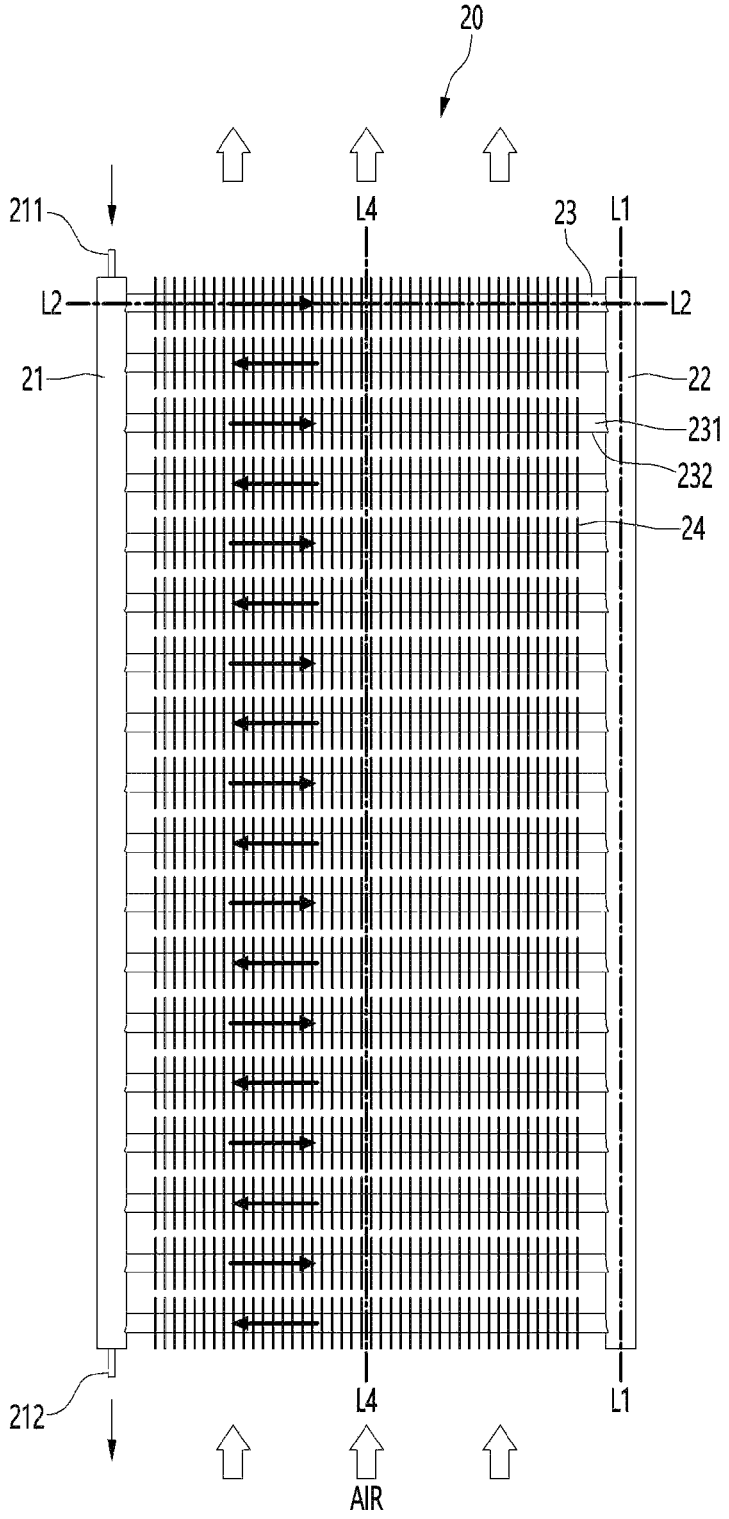

FIG. 3 is a perspective view illustrating the evaporator of the refrigerator according to an embodiment. Also, FIG. 4 is a front view of the evaporator according to an embodiment.

Referring to the drawings, the evaporator 20 according to an embodiment includes a pair of headers 21 and 22 extending in the vertical direction and a plurality of flat tubes 23 to which both ends of the pair of headers 21 and 22 are connected. In addition, a plurality of heat dissipation fins 24 are arranged between the pair of headers 21 and 22 at regular intervals and penetrated by the flat tube 23.

In detail, the headers 21 and 22 according to the embodiment include a first header 21 installed perpendicular to the ground and a second header 22 installed parallel to the first header 21. That is, the headers 21 and 22 are respectively connected to both ends of the flat tube 23, and a single header is disposed at each of both ends of the flat tube 23. Thus, a width of the evaporator 20 in a front and rear direction may be minimized to reduce a space in which the evaporator 20 is accommodated in the main body.

The first header 21 may include a refrigerant inlet 211 through which the refrigerant is introduced and a refrigerant outlet 212 through which the refrigerant is discharged.

The second header 22 may be provided in a cylindrical shape, like the first header 21, and both ends of the second header 22 have a structure in which upper and lower ends are shielded so that the refrigerant passing through the flat tube 23 is guided again toward the first header 21.

Hereinafter, the headers 21 and 22, the flat tube 23, and the heat dissipation fin 24 will be described in detail.

FIG. 5 is a cross-sectional view taken along line V-V' of FIG. 3. FIG. 6 is a cross-sectional view of the flat tube according to an embodiment. FIG. 7 is a cross-sectional view taken along line VII-VII' of FIG. 3. Also, FIG. 8 is a view illustrating a flow of cold air within the evaporator.

A plurality of tube insertion holes 213 for inserting and coupling the flat tube 23 are defined in one side of outer circumferential surfaces of the headers 21 and 22 to correspond to the flat tube 23.

Each of the tube insertion holes 213 may have the same shape as a cross-section of the flat tube 23 so that an end of the flat tube 23 is inserted into each of the headers 21 and 22.

In detail, the flat tube 23 according to an embodiment is coupled to the headers 21 and 22 in a state in which a wide surface 231 is inclined at a set angle with the extension direction of the headers 21 and 22.

Thus, the tube insertion hole 213 may be defined inclined at the set angle with respect to the direction in which the headers 21 and 22 extend. That is, the upper end and the lower end of the tube insertion hole 213 are not disposed in the same extension line in the vertical direction. Due to this structure, the flat tube 23 having the inclined structure may be coupled to the headers 21 and 22 in a state of being smoothly inserted.

In detail, the tube insertion hole 213 may be defined at a predetermined angle along the outer circumferences of the headers 21 and 22. In detail, the tube insertion hole 213 may be defined so that an angle between the extension direction (in the direction perpendicular to the ground) of the headers 21 and 22 and the tube insertion hole 213 is about 90 degrees or less. The angle defined by the tube insertion hole 213 may be, for example, about 20 degrees to about 80 degrees or about 20 degrees to about 60 degrees, preferably about 25 degrees to about 35 degrees.

In addition, a plurality of baffles 214 are provided inside the first header 21 and the second header 22 to provide a meander line defined by a shape of the flow path of the refrigerant flowing along the flat tube 23. The flow path of the refrigerant flowing along the flat tube 22 may be provided as the meander line to increase in contact area and contact time between the refrigerant and the cold air, thereby improving heat exchange efficiency.

The baffle 214 may be installed parallel to the ground. The baffle 214 may be provided between the plurality of flat tubes 23 inside the first header 21.

In addition, the baffle 214 may be provided between the plurality of flat tubes 23 inside the second header 22.

Also, the refrigerant inlet 211 through which the refrigerant is introduced and the refrigerant outlet 212 through which the refrigerant is discharged are provided in any one of the pair of headers 21 and 22.

For example, the refrigerant inlet 211 may be provided at an upper end of the first header 21, and the refrigerant outlet 212 may be provided at a lower end of the first header 21. Then, the refrigerant introduced through the refrigerant inlet 211 may move from the first header 21 to the second header 22 and then move from the second header 22 to the first header 21. Here, the flow of the refrigerant in the above-described directions may be repeated several times, and then, the refrigerant may be discharged to the refrigerant outlet 212.

The plurality of flat tubes 23 in which the refrigerant is heat-exchanged with the outside while guiding the refrigerant introduced into the first header 21 to return again to the first header 21 via the second header 22 may be provided.

Each of the flat tubes 23 may have one end inserted into the first header 21 and the other end inserted into the second header 22 and be disposed between the first header 21 and the second header 22.

The plurality of flat tubes 23 may be arranged along a length along which the first header 21 and the second header 22 extend in the direction perpendicular to the ground.

The flat tube 23 may be provided in a rectangular plate shape. In addition, the flat tube 23 may be coupled to the headers 21 and 22 in a state of being inclined at a set angle.

In addition, the plurality of flat tubes 22 are coupled to the header 21 in a state in which the wide surface 231 is inclined to face the front and rear direction. That is, the wide surface 231 of the flat tube 23 may be disposed in a direction crossing the flow direction L4 of the cold air. Due to this structure, the contact area between the surface of the flat tube 23 and the cold air may increase without maximally interrupting the flow of the cold air.

In a state in which the flat tube 23 is coupled to the headers 21 and 22, the flat tube 23 may be disposed so that a relatively wide surface 231 of the flat tube 23 defines a front surface and a rear surface, and a relatively narrow surface 232 of the flat tube 23 defines a top surface and a bottom surface. Of course, since the flat tube 23 is coupled to the headers 21 and 22 in the state of being inclined at the set angle, the front and rear surfaces of the flat tube 23 may not be disposed to be perpendicular to the ground in the state of being coupled to the headers 21 and 22.

The flat tube 23 is disposed between the first header 21 and the second header 22. Hereinafter, the flat tube 23 according to an embodiment of the present invention will be described in detail.

The flat tube 23 may be coupled to the headers 21 and 22 in a direction crossing the extension direction of the headers 21 and 22. The flat tube 23 may be coupled to the headers 21 and 22 in the state of being inclined at the set angle. In addition, the flat tubes 23 may be arranged at regular intervals in the extension direction L1 of the headers 21 and 22.

In detail, the flat tube 23 may be coupled to the headers 21 and 22 in a shape of rotating forward and backward at a set angle by using a central line L2 of the wide surface 231 as a rotation axis in the state in which the wide surface 231 of the flat tube 23 is perpendicular to the ground.

In other words, the flat tube 23 may be inserted into and coupled to the headers 21 and 22 in a state in which the wide surface 231 of the flat tube 23 rotates at a set angle in a clockwise or counterclockwise direction by using the central line L2 of the wide surface 231 as a rotation axis in the state in which the wide surface 231 is horizontal with the ground.

That is, in a state in which the flat tube 23 is coupled to the headers 21 and 22, the upper end and the lower end of the flat tube 23 are not disposed in the same extension line in the direction perpendicular to the ground.

The upper end of the flat tube 23 may be inclined forward and backward from the lower end of the flat tube 23. Due to this structure, the wide surface 231 of the flat tube 23 may be coupled to the headers 21 and 22 in the state of being inclined in a direction crossing the flow direction of the cold air, and thus, the contact area between the surface of the flat tube 23 and the cold air may increase without interrupting the flow of the cold air.

Referring to FIGS. 6 and 7, an angle between the longitudinal direction (i.e., the direction perpendicular to the ground), in which the first header 21 or the second header 22 extends, and one end or the other end defining both side surfaces of the flat tube 23 may be inclined at about 90 degrees or less.

In detail, an angle θ1 between a central line L3 of a vertical cross-section of the flat tube 23 and the extension direction L1 of the headers 21 and 22 may be about 20 degrees to about 80 degrees or about 20 degrees to about 60 degrees, preferably about 25 degrees to about 35 degrees.

As a specific example, the flat tube 23 may be coupled to the headers 21 and 22 in a state of being inclined so that the angle θ1 between the central line L3 of the vertical cross-section of the flat tube 23 inserted into the first header 21 or the second header 22 and the central line L1 of the headers 21 and 22 is about 20 degrees to about 80 degrees or about 20 degrees to about 60 degrees, preferable about 25 degrees to about 35 degrees.

In other words, in the state in which the evaporator is installed in the refrigerator, the cold air flows from the lower end to the upper end of the evaporator, that is, in the vertical direction. An angle θ2 between the flow direction L4 of the cold air and the central line L3 of the vertical cross-section of the flat tube 23 may be inclined to about 90 degrees or less.

That is, the flat tube 23 may be disposed so that the cross-section of the flat tube 23 has an angle of about 20 degrees to about 80 degrees or about 20 degrees to about 60 degrees, preferably about 25 degrees to about 35 degrees with respect to the flow direction of the cold air.

A plurality of microchannels 233 extending in the horizontal direction of the flat tube 23 are provided inside the flat tube 23. In addition, the plurality of the microchannels 233 may be arranged inside the flat tube 23.

The flow direction L4 of the cold air and the arrangement direction of the microchannels 233 may have a set angle therebetween. That is, the microchannels 233 may be arranged in a direction crossing the flow direction of the cold air passing through the evaporator.

For example, the cold air passing through the evaporator may flow from the lower end to the upper end of the evaporator. Also, the arrangement direction of the microchannels 233 may cross the flow direction of the cold air at a predetermined angle. For example, an angle between the arrangement direction L4 of the microchannel 233 and the flow direction L4 of the cold air may be about 90 degrees or less, preferably about 20 degrees to about 80 degrees, about 20 degrees to about 60 degrees, more preferably about 20 degrees to about 35 degrees.

Here, the arrangement direction L4 of the microchannels 233 means a line connecting a microchannel disposed at the uppermost end of the flat tube to a microchannel disposed at the uppermost end of the flat tube among the plurality of microchannels 233 provided in the flat tube.

When the arrangement direction L4 of the microchannels 233 is described differently, the plurality of microchannels 233 may be arranged at an angle of about 90 degrees with respect to the central line L1 of the header.

Also, the heat dissipation fin 24 that is coupled between the flat tubes 23 to be in contact with each other, thereby expanding the contact area with the cold air is provided. The heat dissipation fins 24 are in contact with the flat tube 23 to effectively dissipate heat conducted to the flat tube 23 to the outside.

The heat dissipation fin 24 may be provided in a square or rectangular plate shape and includes a through-surface 241 through which the flat tube 23 passes. The heat dissipation fins 24 may be provided in plurality by being spaced apart from each other at set intervals in the direction from the first header 21 to the second header 22.

In addition, the through-surface 241 may extend in the same direction as the flow direction L4 of the cold air. That is, the plurality of the heat dissipation fins 24 may be arranged at regular intervals on the flat tube 23 along the direction of the flow path of the refrigerant. In addition, the direction in which the heat dissipation fins 24 are arranged may be a direction crossing the flow direction L4 of the cold air, i.e., the vertical direction.

A tube hole 242 through which the flat tube 23 passes is defined in the through-surface 241 of the heat dissipation fin 24. The tube hole 242 may be defined to have a shape corresponding to the cross-section of the flat tube 23. In detail, the tube hole 242 may be formed to be inclined forward or backward from an upper end to a lower end thereof.

In other words, when the flat tube 23 passing through the heat dissipation fin 24 is mounted on the pair of headers 21 and 22, the upper end and the lower end of the tube hole 242 may not be disposed on the same extension line in the vertical direction. For example, the upper end of the tube hole 242 may be disposed relatively backward from the lower end, and the lower end of the tube hole 242 may be disposed at a relatively front side.

Alternatively, the upper end of the tube hole 242 may be disposed relatively forward from the lower end, and the lower end of the tube hole 242 may be disposed relatively rearward from the upper end.

That is, the tube hole 242 may be defined to be inclined by a set angle from the direction in which the heat dissipation fins 24 are arranged in the vertical direction.

In detail, in the tube hole 242, an angle between a surface of the heat dissipation fin 24, which extends in the vertical direction, and a cross-section of the tube hole 242 may be about 90 degrees or less. Specifically, the angle between the tube hole 242 and the surface of the heat dissipation fin 24, which extends in the vertical direction, may be about 20 degrees to about 80 degrees or about 20 degrees to about 60 degrees, preferably about 25 degrees to about 35 degrees.

Due to the structure of the tube hole 242, when the flat tube 23 is coupled to the headers 21 and 22 in the state of being inclined at the set angle, the tube hole 242 may also have a shape corresponding thereto, and thus, the heat dissipation fin 24 may be coupled to the flat tube 23 in the state perpendicular to the ground. That is, the through-surface 241 through which the flat tube 23 passes may be included in the evaporator in the state of being perpendicular to the ground.

As described above, each of the tube hole 242 defined in the heat dissipation fin 24 and the tube insertion hole 213 defined in the headers 21 and 22 may have a shape corresponding to the cross-section of the flat tube 23. That is, the flat tube 23 may be provided so that the tube hole 242 and the tube insertion hole 213 are inclined at the same angle as the angle between the central line L1 of the headers 21 and 22 or the flow direction L4 of the cold air and the ground.

The plurality of the heat dissipation fins 24 may be arranged in a line along the horizontal extension direction of the flat tube 23. In detail, the plurality of heat dissipation fins 24 may be arranged in the horizontal direction along the flat tube 23 from the first header 21 to the second header 22.

In addition, the outer circumferential surfaces of the first header 21 and the second header 22 and the heat dissipation fins 24 may be disposed to be spaced apart from each other at regular intervals.

The heat dissipation fins 24 may be provided at predetermined intervals between two adjacent flat tubes 23. That is, the heat dissipation fin 24 passing through the single flat tube 23 may be disposed at predetermined intervals from the heat dissipation fin 24 passing through the adjacent flat tube 23.

That is, the heat dissipation fins 24 may not be connected to each other in the vertical direction between the flat tubes 23 adjacent to each other, but may be independently disposed. Thus, a spaced space may be defined between the heat dissipation fins 24 adjacent in the vertical direction.

In other words, the plurality of the heat dissipation fins 24 may be arranged at regular intervals from the first header 21 to the second header 22 along the single flat tube 23. In addition, the plurality of the heat dissipation fins 24 may be arranged at regular intervals between the flat tubes 23 adjacent to each other.

That is, when the flat tube 23 is coupled to the headers 21 and 22, the direction in which the heat dissipation fins 24 are horizontally arranged at set intervals is the same as the flow direction of the refrigerant. In addition, the direction in which the heat dissipation fins 24 are vertically arranged at set intervals may be the same as the flow direction of the cold air.

Due to this structure, the contact area with the cold air may be maximized, the discharge passage of the condensed water may be provided, and the condensed water condensed on the surface of the heat dissipation fin 24 may be easily discharged.

Since the flat tube 23 is brazed to be bonded by passing through a high-temperature heating furnace in a state of being coupled to pass through the heat dissipation fin 24, a gap may not occur between the tube hole 242 defined in the heat dissipation fin 24 and the flat tube 23.

Due to this structure, as illustrated in FIG. 8, the cold air-side heat transfer efficiency may be maximized without interrupting the flow of the cold air as much as possible.

In detail, as illustrated in FIG. 8, a flow b of the cold air of the flat-tube type evaporator according to an embodiment may be secured to be very similar to a flow a of the cold air of the fin-tube type evaporator.

Therefore, the flat tube 23 coupled to the headers 21 and 22 to have the inclined structure may be applied to the evaporator to improve the heat exchange efficiency with the cold air while minimizing the installation space of the evaporator compared to the fin-tube type evaporator.

INDUSTRIAL APPLICABILITY

In the embodiment, the flat tube heat exchanger is applied to improve heat exchange efficiency and reduce a space for accommodating an evaporator, thereby increasing in capacity of the refrigerator.

Therefore, industrial applicability is significantly high.

What is claimed is:

1. A refrigerator, comprising:

a body having a storage space; and an evaporator disposed in the body and configured to cool air supplied to the storage space, the air passing in a flow direction from a lower end of the evaporator to an upper end of the evaporator, wherein the evaporator comprises:

a first header having a central line that extends in a first direction;

a second header that faces the first header;

a plurality of flat tubes coupled to the first header and the second header, and configured such that a refrigerant flows through the plurality of flat tubes; and a plurality of plate-shaped heat dissipation fins each penetrated by at least one of the plurality of flat tubes, wherein each of the plurality of flat tubes has a plate shape and is coupled to the first header and to the second header at an incline having a set angle, wherein the plurality of flat tubes is arranged along the first header or the second header in the first direction, wherein the plurality of heat dissipation fins is arranged in the first direction spaced apart from each other at set intervals, the set intervals forming a spacing between adjacent heat dissipation fins of the plurality of heat dissipation fins between two adjacent flat tubes of the plurality of flat tubes, and wherein a spacing distance between the adjacent heat dissipation fins in the first direction is smaller than a length of each of the heat dissipation fins in the first direction.

2. The refrigerator according to claim 1, wherein the flat tube is connected to the first header or the second header at a first angle defined by a central line of a vertical cross-section of the flat tube and the first direction of the first header or the second header, and wherein the first angle is within a range of about 20 degrees to about 80 degrees.

3. The refrigerator according to claim 1, wherein the flat tube includes an upper end, a lower end, a front surface between the upper end and the lower end, and a rear surface between the upper end and the lower end, and wherein the upper end of the flat tube is inclined forward or backward from the lower end of the flat tube.

4. The refrigerator according to claim 3, wherein the front surface of the flat tube is connected to the first header or the second header at an incline in a direction crossing the flow direction of the air.

5. The refrigerator according to claim 1, wherein the first header is connected to each first end of the plurality of flat tubes, and the second header is connected to each second end of the plurality of flat tubes.

6. The refrigerator according to claim 1, wherein each of the plurality of flat tubes includes a plurality of microchannels through which the refrigerant flows, and wherein the plurality of microchannels is arranged within the corresponding flat tube in a direction crossing the flow direction of the air.

7. The refrigerator according to claim 6, wherein the plurality of microchannels is arranged within the corresponding flat tube in a direction inclined at an angle of about 90 degrees with respect to a central line of the first header.

8. The refrigerator according to claim 1, wherein the first header includes a tube insertion hole to receive the flat tube, and wherein the tube insertion hole is defined along an outer surface of the first header and is inclined at the set angle with respect to a central line of the first header.

9. The refrigerator according to claim 8, wherein the tube insertion hole includes an upper end and a lower end which are not disposed in a same extension line in the first direction.

10. The refrigerator according to claim 1,
wherein the heat dissipation fin includes a through-surface through which the flat tube passes, and
wherein the through-surface of the heat dissipation fin is perpendicular to ground and is parallel to the first direction.

11. The refrigerator according to claim 1,
wherein the heat dissipation fin includes a tube hole through which the flat tube passes, and
wherein a shape of the tube hole corresponds to a cross-section of the flat tube.

12. The refrigerator according to claim 1,
wherein the first header includes:
a refrigerant inlet at an upper end of the first header, and configured to receive the refrigerant, and
a refrigerant outlet provided at a lower end of the first header.

13. A refrigerator, comprising:
a body having a storage space; and
an evaporator disposed in the body and configured to cool air that passes in a flow direction from a lower end of the evaporator to an upper end of the evaporator,
wherein the evaporator comprises:
a first header that extends in a first direction;
a second header that faces the first header and that extends in a second direction parallel to the first direction;
a plurality of tubes having a flat shape, each of the tubes separately coupled to the first header and to the second header; and
a plurality of heat dissipation fins each provided along a different one of the plurality of tubes,
wherein each of the tubes is separately coupled to the first and second headers at an inclined angle with respect to the first direction,
wherein the plurality of tubes is arranged along the first header or the second header in the first direction,
wherein the plurality of heat dissipation fins is arranged in the first direction spaced apart from each other at set intervals, the set intervals forming a spacing between adjacent heat dissipation fins of the plurality of heat dissipation fins between two adjacent tubes of the plurality of tubes,
wherein a spacing distance between the adjacent heat dissipation fins in the first direction is smaller than a length of each of the heat dissipation fins in the first direction.

14. The refrigerator according to claim 13,
wherein the inclined angle is within a range of 20 degrees to 80 degrees.

15. A refrigerator, comprising:
a body having a storage space; and
an evaporator disposed in the body and configured to cool air that passes in a flow direction from a lower end of the evaporator to an upper end of the evaporator,
wherein the evaporator comprises:
a first header that extends in a first direction;
a second header that faces the first header and that extends in a second direction parallel to the first direction;
a plurality of flat tubes connected to the first header and the second header, each flat tube having a front surface, a rear surface, an upper surface, and a lower surface; and
a plurality of plate-shaped heat dissipation fins each penetrated by a different one of the plurality of flat tubes,
wherein each of the flat tubes is separately coupled to each of the first and second headers at an inclined angle defined based on the front surface and the first direction,
wherein the plurality of flat tubes is arranged along the first header or the second header in the first direction,
wherein the plurality of heat dissipation fins is arranged in the first direction spaced apart from each other at set intervals, the set intervals forming a spacing between adjacent heat dissipation fins of the plurality of heat dissipation fins between two adjacent flat tubes of the plurality of flat tubes, and
wherein a spacing distance between the adjacent heat dissipation fins in the first direction is smaller than a length of each of the heat dissipation fins in the first direction.

16. The refrigerator according to claim 15,
wherein the inclined angle is within a range of 20 degrees to 80 degrees.

17. The refrigerator according to claim 15,
wherein each of the flat tubes includes a plurality of microchannels through which the refrigerant flows,
wherein the plurality of microchannels is arranged within the flat tube at an inclined angle with respect to a central line of the first header, and
wherein the inclined angle is within a range of 20 degrees to 80 degrees.

* * * * *